US009538830B2

(12) United States Patent
Ashburn

(10) Patent No.: US 9,538,830 B2
(45) Date of Patent: Jan. 10, 2017

(54) EYELINER WITH APPLICATION GUIDE CAP

(71) Applicant: Dana Rae, LLC, New Hope, PA (US)

(72) Inventor: Dana Ashburn, New Hope, PA (US)

( * ) Notice: Subject to any disclaimer, the term of this patent is extended or adjusted under 35 U.S.C. 154(b) by 50 days.

(21) Appl. No.: 14/675,146

(22) Filed: Mar. 31, 2015

(65) Prior Publication Data

US 2016/0286936 A1 Oct. 6, 2016

(51) Int. Cl.
*A45D 40/20* (2006.01)
*A45D 40/30* (2006.01)
*A45D 34/04* (2006.01)

(52) U.S. Cl.
CPC ..... *A45D 40/30* (2013.01); *A45D 34/04* (2013.01); *A45D 40/20* (2013.01)

(58) Field of Classification Search
CPC .. A45D 40/20; A45D 40/30; A45D 2040/201; A45D 2034/002; A45D 2200/1072
USPC ..... 132/216, 218, 319, 200; 401/193, 202, 401/243, 247
See application file for complete search history.

(56) References Cited

U.S. PATENT DOCUMENTS 3,485,251 A 12/1969 Louise
3,763,870 A * 10/1973 Montgomery ..... A45D 40/267 132/218
D264,824 S * 6/1982 Sandel ..... D10/71
D272,421 S * 1/1984 Sandel ..... 401/195
5,050,624 A 9/1991 Kobe et al.
5,178,170 A * 1/1993 Kassai ..... A45D 40/18 132/216
5,186,190 A 2/1993 Hirzel
6,010,266 A 1/2000 Schrepf
D467,034 S 12/2002 Jaggers
6,972,022 B1 * 12/2005 Griffin ..... A61B 90/39 604/112
7,044,142 B2 5/2006 Gueret
D564,585 S * 3/2008 Wertime ..... D19/133
8,074,667 B2 12/2011 Villanueva
8,221,015 B2 7/2012 Gueret
8,303,204 B2 11/2012 Kurek
8,444,338 B2 5/2013 Kurek et al.
8,464,733 B2 6/2013 Franklin et al.
8,925,558 B2 1/2015 Johnson
8,939,159 B2 1/2015 Yeo et al.
2004/0255971 A1 12/2004 Houghton
2006/0225761 A1 * 10/2006 Secosky ..... A45D 40/18 132/218

(Continued)

FOREIGN PATENT DOCUMENTS

WO 2010082709 A1 7/2010

OTHER PUBLICATIONS

Alexandra Daluisio; Sep. 18, 2014; "13 Winged Eyeliner Hacks and Tricks that'll Change your Makeup Routine"; http://www.teen.com/2014/09/18/style/liquid-winged-eyeliner-hacks-tips-tricks-pictures/.

*Primary Examiner* — Tatiana Nobrega
(74) *Attorney, Agent, or Firm* — IP Works, PLLC; Wayne D. Carroll

(57) ABSTRACT

A cap for eyeliner makeup is disclosed with a guide edge that can be used to apply the eye liner. The cap may include a beveled section adjacent to the guide edge, and finger indents to assist in holding and positioning the guide edge. The cap may be used to protect an applicator tip of liquid, gel or pencil eyeliner makeup. A method of using a cap for eyeliner makeup is also disclosed.

3 Claims, 3 Drawing Sheets

(56) References Cited

U.S. PATENT DOCUMENTS

| | | | | |
|---|---|---|---|---|
| 2009/0214283 | A1 | 8/2009 | Thiebaut | |
| 2013/0247928 | A1 | 9/2013 | Valucci et al. | |
| 2014/0050514 | A1 | 2/2014 | Uehara | |
| 2014/0069448 | A1* | 3/2014 | Forsythe | A45D 40/30<br>132/200 |
| 2016/0143415 | A1* | 5/2016 | Laaly | A45D 34/04<br>401/193 |

* cited by examiner

EYELINER WITH APPLICATION GUIDE CAP

BACKGROUND

1. Technical Field

This disclosure relates to implements for personal grooming, and specifically eyeliner containers and implements for applying eyeliner.

2. Background Art

Eyeliner makeup is commonly used to enhance the look of the eyes. Eyeliner makeup can be difficult to apply. One popular style of applying makeup is to make a "wing" or "cat-eye" (referred to as a cat-eye) at the outer edge of each eye. The desired cat-eye look includes a balanced cat-eye at the corner of each eye, with both cat-eyes being about the same size. Some eyeliner makeup is difficult to remove after it is applied, and may require makeup removal cream or other methods to remove. If a cat-eye is applied to the face and the user wants to change it, they may be required to wash off the cat-eye, which might disturb other makeup already applied. An improved method and tool is needed to assist in applying eyeliner with a cat-eye look.

BRIEF SUMMARY

A cap for eyeliner makeup is disclosed. The cap may include an interior, an exterior, an open end, a closed end at an opposite position from the open end, and a guide edge on the exterior of the cap along the closed end of the cap. The cap may also include a bevel contour adjacent to the guide edge.

In some embodiments the guide edge includes a rubberized edge. The cap for the eyeliner makeup may have a longitudinal axis from the open end to the closed end, and the guide edge may be at an angle relative to the longitudinal axis. The angle of the guide edge relative to the longitudinal axis may be between about 15 degrees and 90 degrees. The guide edge may be a substantially straight line.

The cap may include a finger indent on the exterior, which may be substantially parallel to the guide edge. The cap may also include an inner cap, which may be at least partially within the interior of the cap for the eyeliner makeup.

The cap may also have a right side and a left side, and the guide edge may define a line between the right side and the left side. The bevel contour may be on the right side of the cap, and the cap may include a second bevel contour on the left side of the cap. The cap may also include a first finger indent on the right side, and a second finger indent opposite the first finger indent on the left side.

Eyeliner makeup is disclosed including eyeliner makeup with an applicator tip for applying the eyeliner makeup to a user's face, and a cap that may have an interior configured to protect the applicator tip. The cap may also include an exterior configured to be used as a guide for applying the eyeliner makeup. The exterior may include a guide edge and a bevel contour adjacent to the guide edge. The eyeliner makeup may be a liquid eyeliner including a storage area for the liquid eyeliner. The applicator tip may be connected to the storage area so that the liquid eyeliner travels from the storage area to the applicator tip. The eyeliner makeup may be a pencil eyeliner, and the pencil eyeliner may have a pencil tip. The applicator tip may be the pencil tip. The eyeliner makeup may also be liquid eyeliner or a gel eyeliner, and the applicator tip may be a brush or a felt tip.

The cap may also include a first finger indent on the right side, and a second finger indent opposite the first finger indent on the left side. The first finger indent may be substantially parallel to the guide edge and the second finger indent may be substantially parallel to the guide edge.

A method of applying eyeliner using a liquid eyeliner pen is disclosed. The liquid eyeliner pen may include a storage area for liquid eyeliner, an applicator tip connected to the storage area so that the liquid eyeliner travels from the storage area to the applicator tip, and a cap having an interior configured to protect the applicator tip and prevent the applicator tip from losing moisture. The cap may include an exterior configured to be used as a guide for applying the liquid eyeliner. The exterior may include a guide edge and a bevel contour adjacent to the guide edge. The method may include the following steps: applying the liquid eyeliner across an upper eyelash line using the applicator tip; holding the cap against a user's face with the guide edge near an outer corner of an eye with the bevel contour against the user's face; and using the guide edge as the guide for application of the liquid eyeliner to the user's face.

The cap may include a bevel contour as a first contour on the right side of the cap, and a second contour on the left side of the cap. The cap may include a first finger indent on the right side, and a second finger indent opposite the first finger indent on the left side. The step of holding the cap against the user's face may include holding the cap with a first finger on the first finger indent, and a second finger on the second finger indent.

The method of applying eyeliner may also include the step of holding the cap against the user's face with the guide near an outer corner of a second eye with the second contour against the user's face, while holding the cap with the first finger on the second finger indent and the second finger on the first finger indent; and the step of using the guide edge as the guide for application of the liquid eyeliner to the user's face near the second eye.

DETAILED DESCRIPTION

Many eyeliners (pens, pencils, and brushes) have a cap that protects the tip of the applicator for the eyeliner makeup and protects the eyeliner product. In an example embodiment the cap has features that allow it to also be used as a guide for applying the eyeliner. The cap may have a guide edge that can be placed against the face next to the eye. In some embodiments the guide edge forms a straight line, and in other embodiments the guide edge is curved.

Eyeliner may be used to apply a "cat-eye" to the face. The cat-eye can be formed by making two straight lines that touch at the end, and applying the eyeliner between the lines. The cat eye may also be made with one of the lines being straight and one of the lines being curved, or with both of the lines being curved.

Figure 1:
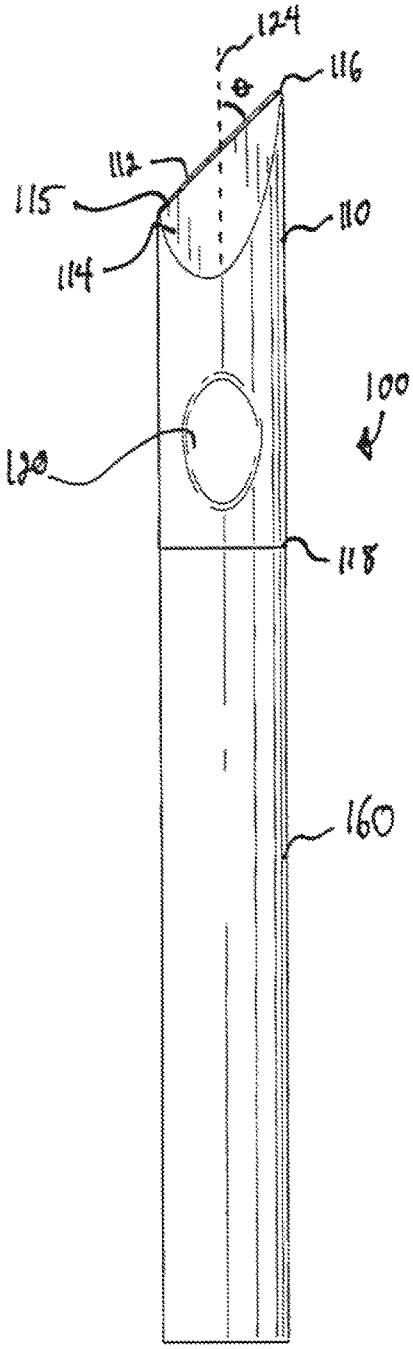
FIG. 1 is a side view of an embodiment of eyeliner makeup with a cap.
Figure 2:
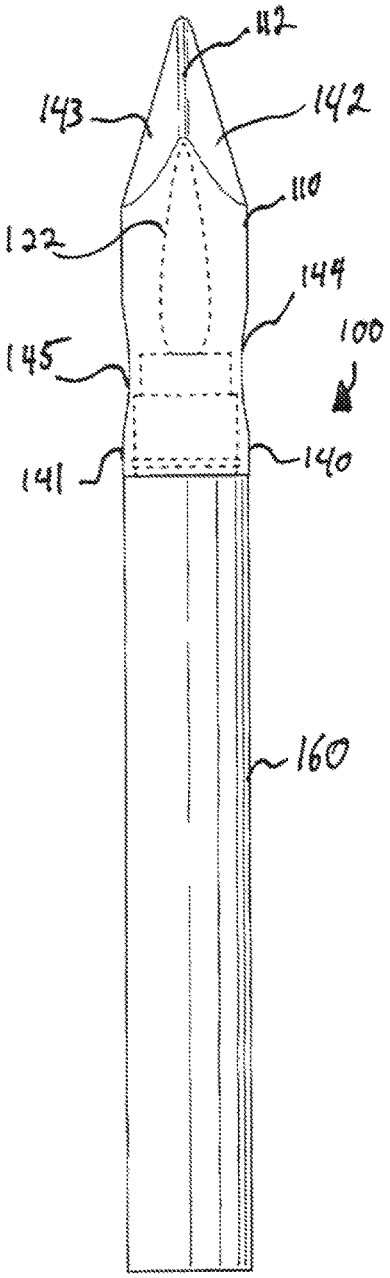
FIG. 2 is a side view of an embodiment of eyeliner makeup with a cap, showing the applicator tip in dotted lines.
Figure 4:
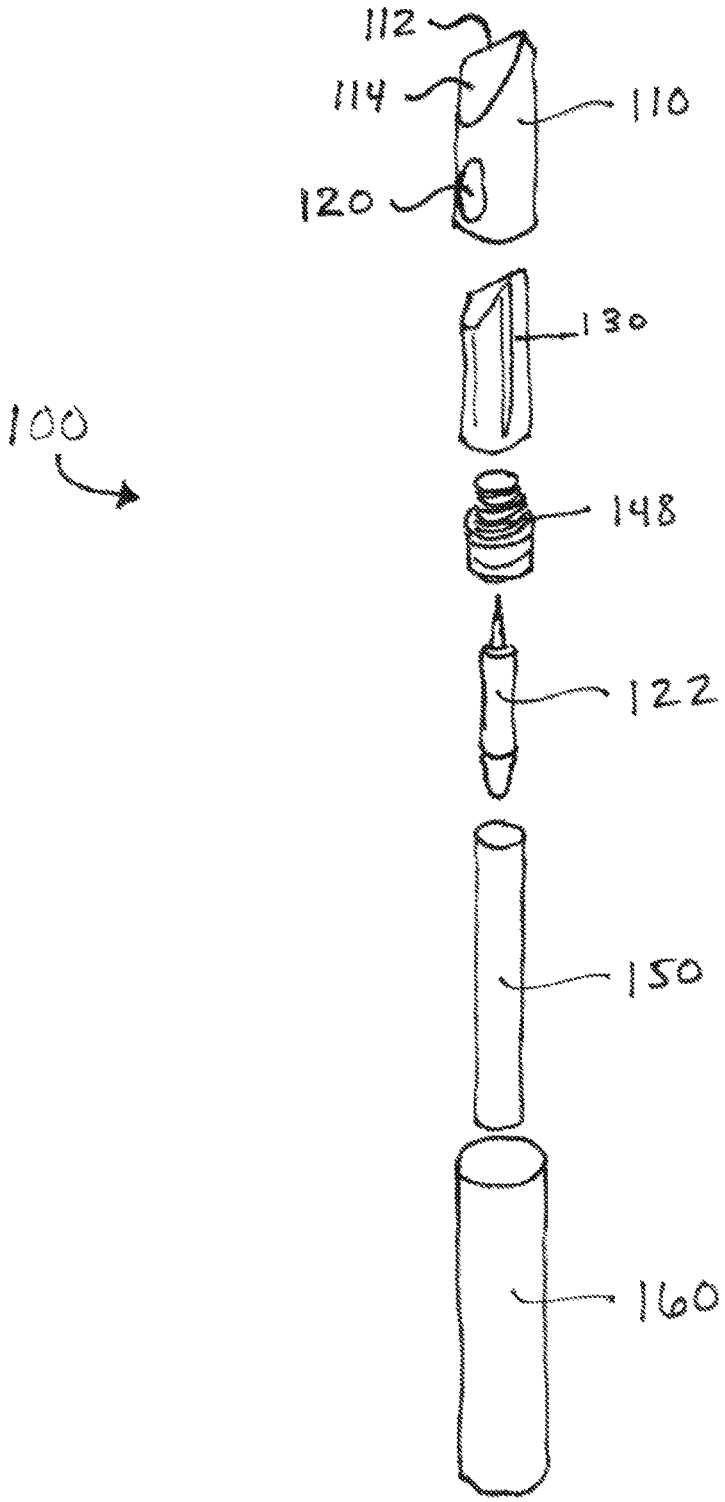
FIG. 4 is an exploded view of another embodiment of the eyeliner makeup.

FIG. 1, FIG. 2, and FIG. 4 show examples of eyeliner makeup 100 with a cap 110. In some embodiments the cap 110 has an inner cap 130 and an outer cap 110. The inner cap 130 may protect the eyeliner applicator. For example if the eyeliner makeup 100 is a liquid eyeliner pen with a felt tip, the inner cap 130 may form a seal with the liquid eyeliner pen to prevent the felt tip from drying out. If the eyeliner is a pencil, the inner cap 130 may fit securely on the pencil to protect the tip from being broken or damaged. The inner cap 130 and the outer cap 110 may be formed together, or separately and assembled. In some embodiments the outer cap 110 is formed and supplied separately and may be configured to be placed on the cap of eyeliner makeup 100 from various suppliers. In the illustrated example embodiments the outer cap 110 covers all of the inner cap 130. In other embodiments the outer cap 110 may cover only a portion of the inner cap 130, and the outer cap 110 may be permanently affixed or removably fixed to the inner cap 130.

In some embodiments the eyeliner makeup 100 is liquid eyeliner, and a device includes a storage area 160 for storing the liquid eyeliner. An applicator tip 122 may be connected to the liquid eyeliner in the storage area 160 so that the liquid eyeliner can travel from the storage area 160 to the applicator tip 122. For example, a wicking material 150 may be placed between the stored eyeliner and the applicator tip 122 so that eyeliner is wicked from the storage area 160 and delivered to the applicator tip 122.

In the example embodiment of FIG. 4 an applicator support 148 is shown, which assists in supporting the applicator tip 122, and sealing the storage area 160 with the liquid eyeliner, so that liquid eyeliner can only leave the storage area 160 through the applicator tip 122.

In some embodiments the outer cap 110 includes a bevel contour 114 on the exterior of the cap adjacent to a guide edge 112. The cap 110 may have a center axis 124 along the center axis of the makeup (along the length of the makeup or the longitudinal axis). The guide edge 112 may intersect the center axis of the cap 110 and form a line defined by two points along the guide edge. The guide edge 112 may defines a right side 140 and a left side 141 of the cap 110. The line defined by the two points along the guide edge may be at an angle θ relative to the center line. In an example embodiment the angle θ of the guide edge relative to the longitudinal axis is between about 15 degrees and 90 degrees.

The cap may have a beveled contour 114 on each side of the guide edge 112, one being on the right side 140 as a first bevel contour 142 and the other on the left side 141 as a second bevel contour 143. The contour 114 may be useful to allow the cap to be held comfortably against the face 230 (shown in FIG. 3) next to the outer corner 233 of the eye 232. The contour 114 may also serve as a shield to protect the face 230 and prevent eyeliner from being applied in unwanted areas.

The cap may also have a finger indent 120 on the right side 140 as a first finger indent 144 and on the left side 141 as a second finger indent 145. The finger indents 120 may be useful to hold the cap 110 securely. The finger indents 120 may also be useful to help position the cap 110 as a guide against the face 230. If fingers are consistently placed over the finger indents then the cap may have the same rotation and position each time when the hand is held in the same position. The finger indents 120 can be useful in applying a consistent and repeatable look with eyeliner makeup.

The first and second finger indents 144, 145 may be opposite each other and may be centered and parallel to the guide edge 112 so that when the finger indents 144, 145 are held at a level position, the guide edge 112 will also be at a level position. In other embodiments the finger indents 144, 145 are placed at other locations relative to the guide edge 112, and may not be directly opposite each other on the cap 110. In some embodiments only one finger indent 120 is placed on the exterior of the cap 110. In other embodiments no finger indents are on the exterior of the cap 110.

The guide edge 112 may be a straight edge or a curved edge. If the guide edge 112 is curved, it may have a single gradual curve, or it may have multiple curves or a pattern. The guide edge 112 may also have a shape to assist in drawing an image with eyeliner. In some embodiments the guide edge 112 has a rubberized edge 115. The rubberized edge 115 may assist in forming a crisp line with eyeliner makeup on the face. In some embodiments the outer cap 110 is made from plastic with a rubberized edge 115 applied along the guide edge 112. In other embodiments the exterior of the cap 110 is coated with a rubberized material in part or in whole including along the guide edge 112. The cap 110 may also be made without a rubberized edge 115.

Figure 3:
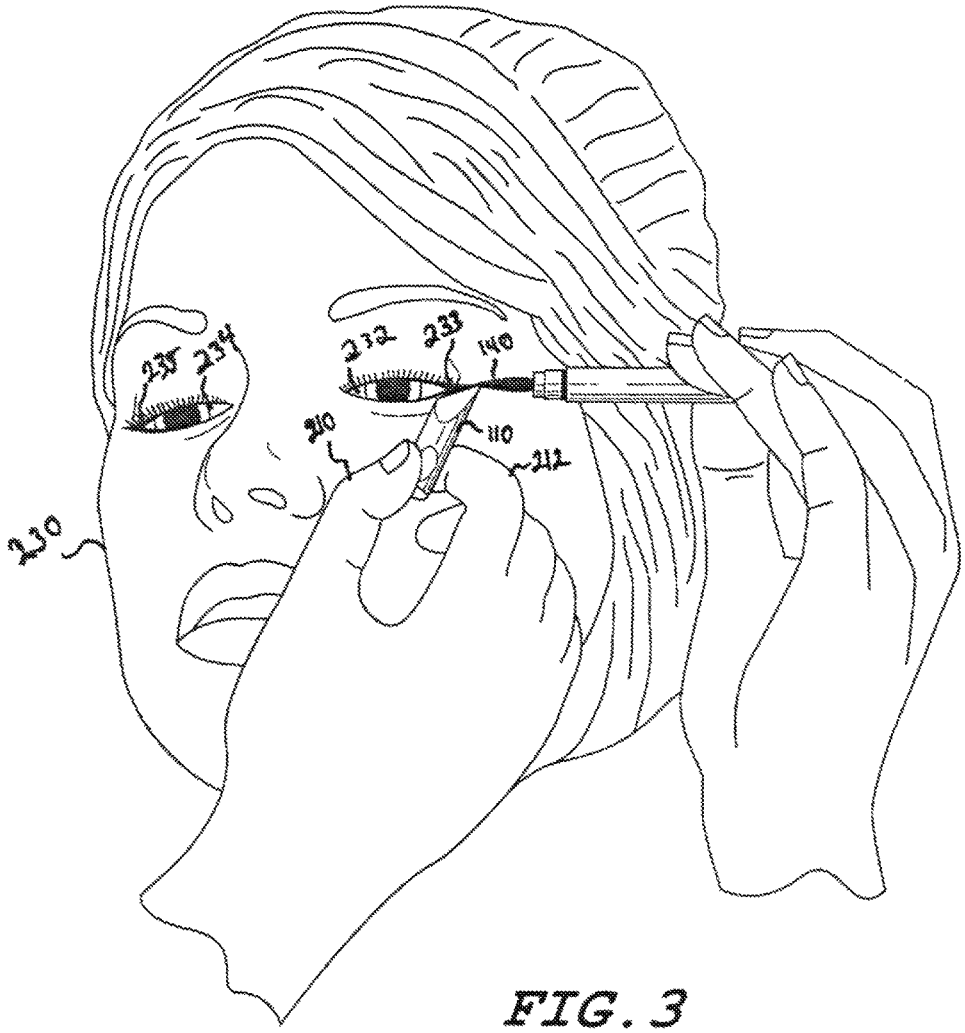
FIG. 3 is a perspective view of a person applying the eyeliner makeup according to an example method.

A method of applying eyeliner may include multiple steps. The example methods discussed below may use eyeliner and structures disclosed above, or other eyeliners and other structures. Method steps may include more or less than the method steps discussed below, and may be carried in the same order and discussed or in a different order. One example step of the method is illustrated in FIG. 3. FIGS. 1-4 may be referenced in the discussion of example methods of applying eyeliner.

A user may apply eyeliner across the upper eyelash line using an applicator. The user may hold a device, such as a cap 110 used to protect the applicator tip, with a guide edge against a user's face 230, with the guide edge 112 near the outer corner 233 of an eye 232. The device may include a bevel contour 114 adjacent to the guide edge 112, and the bevel contour 114 may be placed against the user's face 230. The guide edge 112 may be used as a guide for application of the liquid eyeliner to the user's face 230.

In some embodiments the device has a right side 140 and a left side 141, and there is a first finger indent 144 on the right side 140 and a second finger indent 145 on the left side 141. A user may user a first finger 210 and a second finger 212 (such as a thumb and an index finger) to hold the device against the face 230 of the user. The finger indents 144, 145 may allow a user to hold the device securely and in a similar position each time the device is used to apply eyeliner. The guide edge 112 of the device may be at an angle so that when the device is used in one position, eyeliner may be applied at a first angle, and when the device is rotated 180 degrees the device may be used to apply eyeliner at a second angle similar to the first angle but substantially symmetrical about a center line on the face 230.

The device may be used to apply eyeliner at an angle on the face. In some embodiments the device guide edge 112 is a substantially straight line, and the device held against the face near the outer corner 233 of a first eye 232 (such as the left eye) to apply eyeliner in a first straight line on the face 230 at a first angle. The device may then be rotated so that the first finger 210 of the user is on the second finger indent 145, and the second finger 212 of the user is on the first finger indent 144. The device may be used to apply eyeliner to the face 230 of the user near the outer corner 235 of a second eye 234 (such as a right eye) and apply the eyeliner in a second straight line on the face 230 of the user at a second angle that is substantially symmetrical to the first straight line. In this way a user may apply eyeliner symmetrically to their face 230 (or to another person's face) with well-defined edges of the eyeliner applied to the face if desired.

While the principles of the invention have been made clear in illustrative embodiments, there will be immediately obvious to those skilled in the art many modifications of structure, arrangement, proportions, and methods, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What is claimed is:

1. A method of applying liquid eyeliner using a liquid eyeliner pen, the liquid eyeliner pen comprising:

a storage area containing liquid eyeliner, an applicator tip connected to the storage area so that the liquid eyeliner travels from the storage area to the applicator tip and a cap having an interior configured to protect the applicator tip and prevent the applicator tip from losing moisture, the cap further comprising an exterior configured to be used as a guide for applying the liquid eyeliner, wherein the exterior includes a guide edge and a bevel contour adjacent to the guide edge, the method comprising:

applying the liquid eyeliner across an upper eyelash line using the applicator tip;

holding the cap against a user's face with the guide edge near an outer corner of an eye with the bevel contour against the user's face and using the guide edge as the guide to apply the liquid eyeliner to the user's face.

2. The method of applying eyeliner according to claim 1, wherein the cap has a right side and a left side, and wherein the guide edge defines a line between the right side and the left side, wherein the bevel contour is a first contour on the right side of the cap, and wherein the cap further comprises a second contour on the left side of the cap, the cap further comprising a first finger indent on the right side, and a second finger indent opposite the first finger indent on the left side, wherein the first finger indent is substantially parallel to the guide edge and wherein the second finger indent is substantially parallel to the guide edge, wherein holding the cap against the user's face further includes holding the cap with a first finger on the first finger indent, and a second finger on the second finger indent.

3. The method of applying eyeliner according to claim 2, the method further comprising:

holding the cap against the user's face with the guide near an outer corner of a second eye with the second contour against the user's face, including holding the cap with the first finger on the second finger indent and the second finger on the first finger indent; and using the guide edge as the guide to apply the liquid eyeliner to the user's face near the second eye.

* * * * *